US005427422A

United States Patent [19]

Madlener et al.

[11] Patent Number: 5,427,422

[45] Date of Patent: Jun. 27, 1995

[54] DOOR SECURITY SYSTEM

[76] Inventors: Josef Madlener; Robert Madlener, both of 509 - 52 Avenue, S.W., Calgary, Alberta, Canada, T2V 0B3

[21] Appl. No.: 145,197

[22] Filed: Sep. 24, 1993

[51] Int. Cl.[6] ..... E05C 17/36

[52] U.S. Cl. ..... 292/264; 292/145; 292/346; 292/DIG. 17

[58] Field of Search ..... 292/DIG. 17, 264, 182, 292/346, 300, 288, 289, 292, 259 R, 146, 137, 145

[56] References Cited

U.S. PATENT DOCUMENTS

| | | | |
|---|---|---|---|
| 1,326,554 | 12/1919 | Watson | 292/44 |
| 1,920,669 | 8/1933 | Riccelli | 292/264 |
| 2,454,904 | 11/1948 | Wylie | 292/346 |
| 3,936,085 | 2/1976 | Long | 292/264 |
| 3,937,506 | 2/1976 | Dean | 292/300 |
| 3,970,340 | 7/1976 | Taft | 292/DIG. 17 X |
| 4,085,650 | 4/1978 | Flynn | 292/300 X |
| 4,130,311 | 12/1978 | Sushan | 292/346 |
| 4,161,333 | 7/1979 | Guttman | 292/150 X |
| 4,174,862 | 11/1979 | Shane | 292/346 |
| 4,547,009 | 10/1985 | Allen | 292/346 |
| 4,725,084 | 2/1988 | Catricola | 292/346 X |
| 4,832,388 | 5/1989 | Lozano | 292/DIG. 53 X |
| 5,080,354 | 1/1992 | McDougall | 292/DIG. 17 X |

FOREIGN PATENT DOCUMENTS

| | | | |
|---|---|---|---|
| 1223617 | 6/1987 | Canada | 292/50 |
| 21786 | of 1905 | United Kingdom | 292/264 |

*Primary Examiner*—Rodney M. Lindsey

[57] ABSTRACT

A door security system that includes an interior component system, an exterior component system, a hinge screw component, and a door striker component. The interior system consists of a pair of plates, one mounted on the door and the other mounted on the door jamb. Each plate includes a flanged portion having a pair of apertures. A bolt consisting of a rod and a hook is inserted through one aperture of each plate to secure the door to the door assembly. A chain and hook system is connected between the other two apertures of the respective plates. When only the chain is used, the door can be safely opened partially to preview the prospective visitor. The exterior component consists of a flanged plates wherein a flanged portion is designed to fit into a corresponding slot in the door jamb to inhibit forceful entry into the dwelling. The hinge screw components includes a screw having a threaded portion and a protrusion member. The screw of a traditional hinge is replaced with the hinge screw to prevent a closed door from being removed from their hinges when the hinge pins are removed. The door striker component reinforces the drivein style of dead bolts by supporting the outer edge of the bolt collar.

10 Claims, 2 Drawing Sheets

DOOR SECURITY SYSTEM

FIELD OF THE INVENTION

This invention relates to a door security system, more particularly, to a chain/rod, jimmy plate, hinge screw and door striker locking system for preventing forceable or unauthorized opening of a door.

BACKGROUND OF THE INVENTION

It is well known by security specialists that conventional locking arrangements can be easily overcome without the use of a key. For example, a door could be forcibly opened by using a jimmy bar or crowbar. Although dead bolts are somewhat effective in preventing the use of a crowbar to force the door away from the frame sufficient to allow the latch to clear the strike plate, they do not overcome destructive use of the crowbar.

In addition, dead bolt locks do not solve the problem of unwanted entry through a locked door by a person who has made a copy of the key or who is able to pick the lock.

Door and jamb guard plates have been proposed to increase the effectiveness of dead bolts, such as disclosed in Canadian Patent No. 1,223,617 issued Jun. 30, 1987 to Josef Madlener. However, the system described in Canadian patent 1,223,617 does not provide protection against key or pick entry or special cases where only a limited opening of the door is required.

In addition, such systems do not prevent closed doors from being removed from their hinges when the hinge pins are removed.

Another problem with conventional dead bolt arrangements is the use of merely decorative sleeves used to stabilize the dead bolt itself. These conventional sleeves add only marginal improvement to the rigidity of the bolt structure.

Consequently, there is a need for a door security system that (a) protects the door from being opened by a key (or other non-destructive means) or by being jimmied, (b) assists in the protection provided by existing dead bolt systems, (c) allows the occupant to have a limited clearance when opening the door, (d) prevents closed doors from being removed from their hinges when the hinge pins are removed, and (e) reinforces the drive-in style of dead bolt at the door's edge by supporting the outer edge of the bolt collar, and to distribute prying pressure over a greater area surrounding the dead bolt.

SUMMARY OF THE INVENTION

An object of the preferred embodiment of the present invention is to provide a door security system that makes it more difficult to open a door by either destructive or non-destructive means.

Another object of the present invention is to provide a door security system that permits the occupant to control the clearance of an opened door.

Another object of the present invention is to provide a door security system that assists in preventing closed doors from being removed from their hinges when the hinge pins are removed.

In accordance with one aspect of the invention there is provided a door security system for securing a door having an inside and outside surface to a door frame assembly having a jamb, which includes an elongate slot, said door security system comprising: (a) a first plate for the jamb of the door frame assembly having a mounting portion and a flanged portion, said flanged portion including a first and a second aperture; (b) a second plate for the inside surface of the door having a mounting portion and a flanged portion, said flanged portion including a first and a second aperture; (c) rigid reinforcing means slidably insertable into the first apertures of the first and second plates, wherein when the rigid reinforcing means is inserted into the first apertures of the first and second plates the door is securely engaged to the door frame assembly; and (d) separator means fixedly connected to the second aperture of the first plate and adapted to be removably connected to the second aperture of the second plate for permitting a predetermined amount of separation between the door and the door frame assembly.

In accordance with another aspect of the present invention there is provided a door security system for securing a door having an inside and outside surface to a door frame assembly having a jamb, which includes an elongate slot, said door being pivotally connected to the door frame assembly by a plurality of hinges, each hinge including a pair of pivotally connected plates, said door security system comprising: (a) a first plate for the jamb of the door frame assembly having a mounting portion and a flanged portion, said flanged portion including a first and a second aperture; (b) a second plate for the inside surface of the door having a mounting portion and a flanged portion, said flanged portion including a first and a second aperture; (c) rigid reinforcing means slidably insertable into the first apertures of the first and second plates, wherein when the rigid reinforcing means is inserted into the first apertures of the first and second plates the door is securely engaged to the door frame assembly; (d) separator means fixedly connected to the second aperture of the first plate and adapted to be removably connected to the second aperture of the second plate for permitting a predetermined amount of separation between the door and the door frame assembly; and (e) hinge plate interlocking means for interlocking the pair of plates of at least one of the plurality of hinges when the door is in a closed position.

BRIEF DESCRIPTION OF THE DRAWINGS

Embodiments of the invention will be described by way of example in conjunction with the drawings in which.

DETAILED DESCRIPTION OF EMBODIMENTS OF THE INVENTION

The door security system of the present invention includes an interior component system 10, an exterior component system 48, a hinge screw component 70, and a door striker component 78 illustrated in FIGS. 1, 2, 3A and 3B, and 4, respectively.

Figure 1:
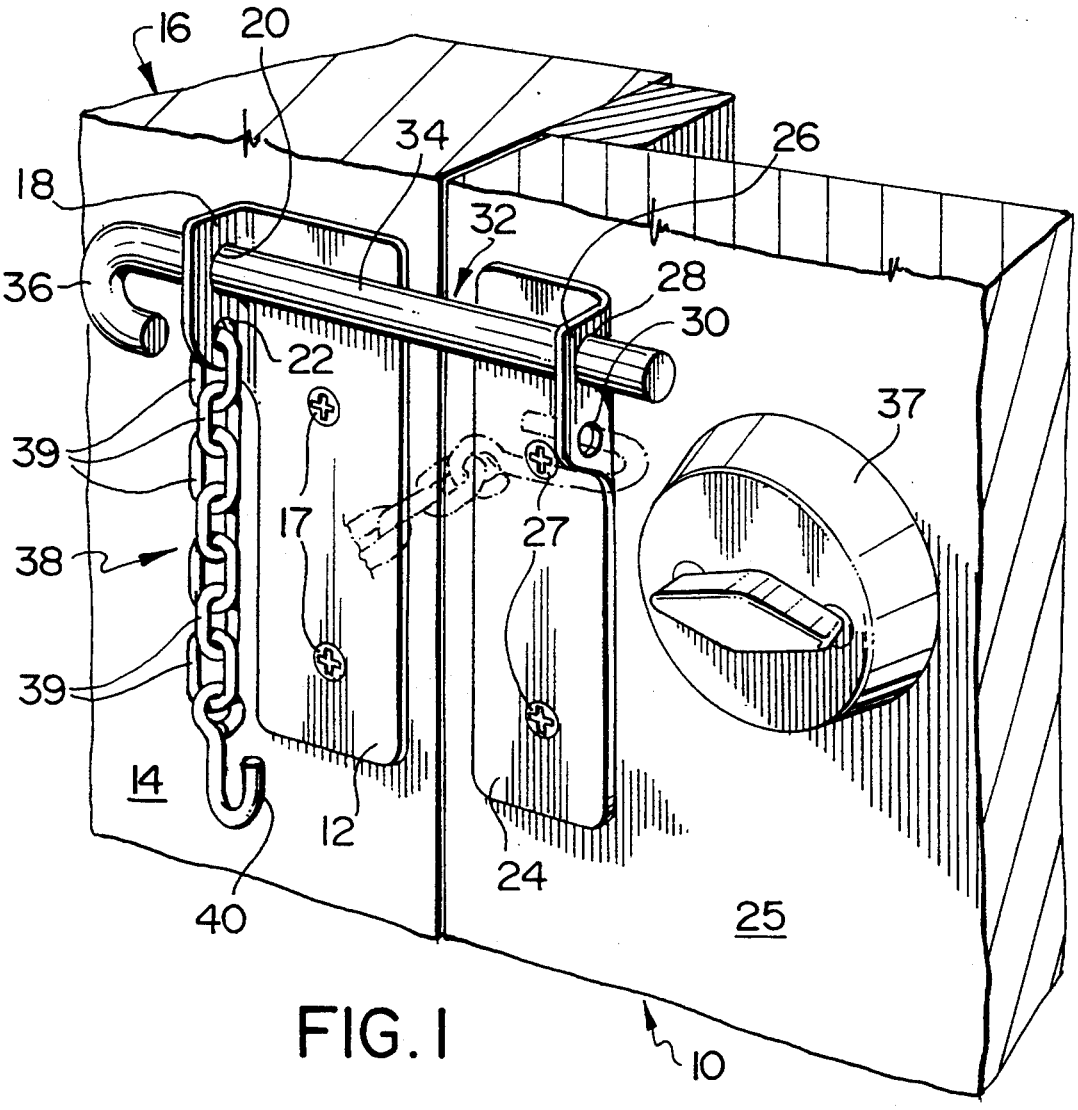
FIG. 1 is a perspective view illustrating the interior component system of the door security system according to the present invention.

The interior component system 10, shown in FIG. 1, includes a door jamb plate 12 that is attached to a door jamb 14 of a door frame assembly 16 by a pair of jamb plate bolts 17. The jamb plate 12 includes a flanged portion 18 having a bolt and a chain aperture, 20 and 22, respectively. A door plate 24 is attached to a door 25 by a pair of door plate bolts 27. The plate 24 includes a flanged portion 26 having a bolt and a chain aperture, 28 and 30, respectively.

The interior system 10 further includes a bolt member 32 having a shaft portion 34 and a hook portion 36. The bolt member 32 is inserted, for example at night, through the bolt apertures 20 and 28 of the plates 12 and 24, respectively.

The plates 12 and 24 and bolt 32 improve the door's 25 resistance to being opened by a key or by being picked, and also helps to backup an existing dead bolt system 37 in the case of forced entry.

A chain 38 comprising a plurality of links 39 and a chain hook 40 is fixedly connected to the chain aperture 22 of flange 18 of plate 12. The chain 38 can be secured to the plate 24 by placing the chain hook 40 into the chain aperture 30 of flange 26.

When the chain 38 is in an engaged position (shown in shadow lines in FIG. 1.), the door 25 can be opened to a limited extent to provide an occupant with the opportunity of prescreen prospective visitors.

Figure 2:
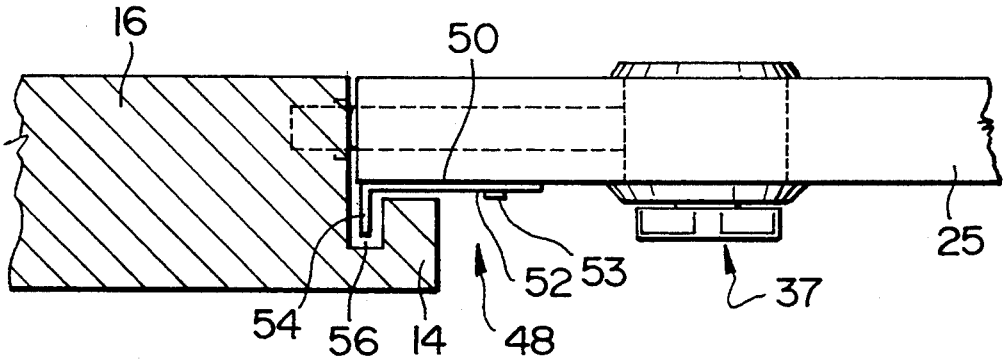
FIG. 2 is a sectional view illustrating the exterior component system of the door security system according to the present invention.

The exterior component system 48, shown in FIG. 2, includes a flanged jimmy plate 50. The plate 50 includes a mounting portion 52 that is mounted to an exterior surface of the door 25 by a pair of jimmy plate bolts 53. The plate 50 is flanged to approximately 90 degrees along one edge to produce a flanged portion 54 that is designed to fit into a prepared slot 56 in the jamb 14. The plate 50 can be used on either interior or exterior swing doors, by merely modifying the receiving slot accordingly.

In operation, the flanged portion 54 of the jimmy plate 50 is positioned within the slot 56 to prevent the door 25 from being pried apart and/or to prevent pestering of the dead bolt system 37 itself.

Figure 3A:
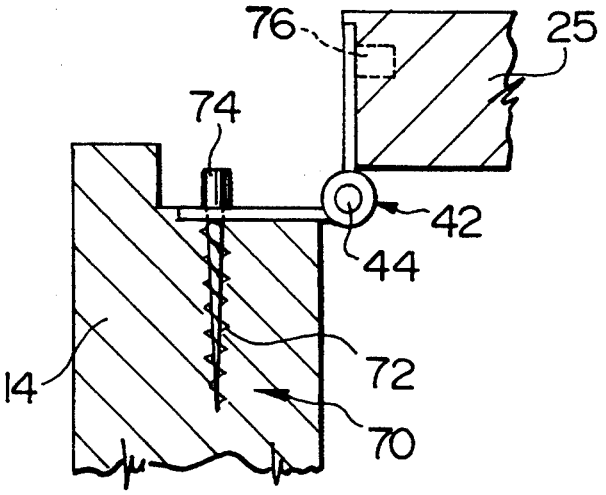
FIG. 3A is a sectional view illustrating the hinge screw component of the door security system mounted to a door frame with the door in the open position.
Figure 3B:
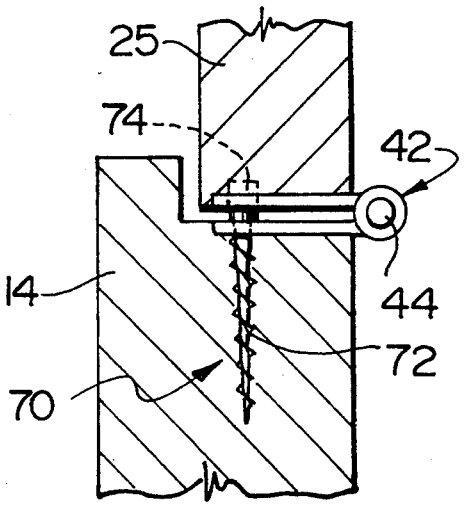
FIG. 3B is a sectional view illustrating the hinge screw component of the door security system mounted to a door frame with the door in the closed position.

The hinge screw component 70, shown in FIGS. 3A and 3B, includes an elongate threaded screw portion 72 and a protrusion member 74. The screw portion 72 can be mounted into a traditional hinge 42 screw hole at the door jamb 14 side of the hinge 42. A corresponding door hinge screw (not shown) is removed to produce a cavity 76 to accommodate the protrusion member 74 of the hinge screw 70.

When the door 25 is closed the protrusion member 74 of the hinge screw 70 enters the cavity 76 in the door 25, as shown in FIG. 3B. One hinge screw 70 is used for each hinge on the door 25. With the door in the closed position, the hinges 42 cannot pass one another if hinge pins 44 are removed.

Figure 4:
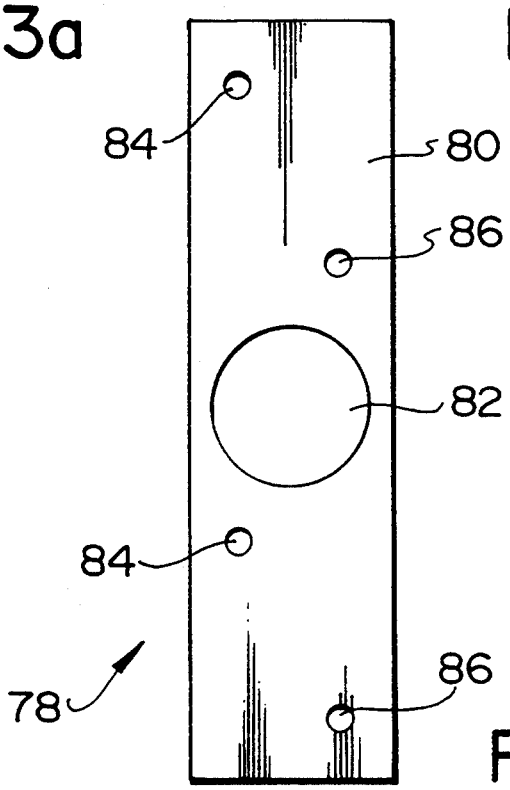
FIG. 4 is a plan view illustrating the door striker plate component of the door security system of the present invention.

The door striker component 78, shown in FIG. 4, includes an elongate plate 80 having a bolt aperture 82, a pair of inner mounting apertures 84 and a pair of outer mounting apertures 86. The apertures 84 and 86 are located at the outer edge of the door (when mounted to an edge of the door 25) to increase the holding strength of the striker 78. The plate 80 is capable to distributing loading and/or prying force over a large surface area, which increases the effectiveness of the door security system.

Although, the plates 12 and 24 and the jimmy plate 50 can be mounted directly to the door 25 and jamb 14, additional strength in the door security system can be achieved by using the guard plates of Canadian Patent No. 1,223,617 issued Jun. 30, 1987 to Josef Madlener. The guard plates disclosed in this patent are mounted through the entire jamb and door, thus providing a very strong security arrangement.

We claim:

1. A door security system for securing a door having an inside and outside surface to a door frame assembly having a jamb, which includes an elongate slot, said door security system comprising:

(a) a first plate for the jamb of the door frame assembly having a mounting portion and a flanged portion, said flanged portion including a first and a second aperture;

(b) a second plate for the inside surface of the door having a mounting portion and a flanged portion, said flanged portion including a first and a second aperture;

(c) rigid reinforcing means slidably insertable into the first apertures of the flanged portions of the first and second plates, wherein when the rigid reinforcing means is inserted into the first apertures of the flanged portions of the first and second plates the door is securely engaged to the door frame assembly; and (d) separator means fixedly connected to the second aperture of the flange portion of the first plate and adapted to be removably connected to the second aperture of the flanged portion of the second plate for permitting a predetermined amount of separation between the door and the door frame assembly when used independently of the rigid reinforcing means.

2. The door security system of claim 1, wherein the rigid reinforcing means includes a bolt having an elongate shaft portion and a hook portion at one end.

3. The door security system of claim 1, wherein the separator means includes a chain having a plurality of links and having a hook portion at one end.

4. The door security system of claim 1, further including a flanged plate for the outside surface of the door having a mounting portion and a flanged portion, said flanged portion being adapted to removably interact with the elongate slot in the door jamb.

5. A combination of a door having an inside major surface, an outside major surface and an edge surface defined between the inside major surface and the outside major surface; a door frame assembly having a jamb; and a door security system comprising:

(a) a first plate mounted on the jamb of the door frame assembly having a mounting portion and a flanged portion, said flanged portion including a first and a second aperture, wherein the first and second apertures are substantially vertically aligned;

(b) a second plate mounted on the major inside surface of the door, said second plate having a mounting portion and a flanged portion, said flanged portion including a first and a second aperture, wherein the first and second apertures are substantially vertically aligned;

(c) rigid reinforcing means slidably insertable into the first apertures of the flanged portions of the first and second plates, wherein when the rigid reinforcing means is inserted into the first apertures of the flanged portions of the first and second plates the door is securely engaged to the door frame assembly;

(d) separator means fixedly connected to the second aperture of the flanged portion of the first plate and adapted to be removably connected to the second aperture of the flanged portion of the second plate for permitting a predetermined amount of separation between the door and the door frame assembly when used independently of the rigid reinforcing means.

6. The door security system of claim 5, wherein the rigid reinforcing means includes a bolt having an elongate shaft portion and a hook portion at one end.

7. The door security system of claim 5, wherein the separator means includes a chain having a plurality of links and having a hook portion at one end.

8. The door security system of claim 5, further including a plurality of hinges mounted between the door and the door frame assembly for pivotally mounting the door to the door frame assembly, each hinge including a first plate mounted to the door frame assembly and a second plate mounted to the edge surface of the door, the first and the second plates each having a plurality of matched apertures; and a screw having a threaded portion for insertion into a selected one of the plurality of apertures of the first plate and a cylindrical protrusion portion adapted to removably engage with a corresponding matched aperture in the second plate such than the first and second plate interlock when the door is in a closed position.

9. The door security system of claim 5, further including an elongate slot in the jamb of the door frame assembly; and a flanged plate mounted to the major outside surface of the door having a mounting portion and a flanged portion, said flanged portion being adapted to removably interact with the elongate slot in the jamb of the door frame assembly.

10. The door security system of claim 5, further including a dead bolt mounted in the door with the dead bolt projecting through the edge surface of the door at a dead bolt projection position to engage with a corresponding dead bolt aperture in the frame assembly; and a door striker plate mounted to the edge surface of the door at the dead bolt projecting position to accommodate the dead bolt, said door striker plate having a pair of inner and outer mounting apertures, wherein when the door striker plate is mounted to the edge surface of the door the mounting apertures are positioned proximate the ends of the edge surface.

* * * * *